US005169075A

United States Patent [19]

Galanty

[11] Patent Number: 5,169,075

[45] Date of Patent: Dec. 8, 1992

[54] CRUSHING DEVICE

[76] Inventor: William B. Galanty, 16 Falmouth St., Short Hills, N.J. 07028

[21] Appl. No.: 678,016

[22] Filed: Apr. 1, 1991

[51] Int. Cl.[5] ..... B02C 23/00

[52] U.S. Cl. ..... 241/46.04; 241/46.08; 241/243; 241/285.3

[58] Field of Search ..... 241/285 A, 285 B, 285 R, 241/243, 285.1, 285.2, 285.3, 46.06, 46.04, 46.08, 46.017, 46.013, 46.01; 210/173, 174

[56] References Cited

U.S. PATENT DOCUMENTS

| | | | |
|---|---|---|---|
| 1,706,643 | 3/1929 | Wiley | 241/285 B X |
| 2,591,388 | 4/1952 | Trotter | 241/46.08 X |
| 2,816,716 | 12/1957 | Webb | 241/285.3 X |
| 2,870,969 | 1/1959 | Moore | 241/238 |
| 3,091,338 | 5/1963 | Nordell | 210/174 |
| 3,419,223 | 12/1968 | Morin | 241/285 B X |
| 3,556,421 | 1/1971 | Galanty | 241/86 |
| 3,652,022 | 3/1972 | Miner et al. | 241/185 |
| 3,756,519 | 9/1973 | Reynolds et al. | 241/285 B X |
| 3,812,967 | 5/1974 | Rudzinski | 210/174 |
| 3,893,923 | 7/1975 | Rudzinski | 210/174 X |
| 3,976,252 | 8/1976 | Perdue | 241/46.02 |
| 4,043,514 | 8/1977 | Peterson, Jr. | 241/285 B X |
| 4,186,888 | 2/1980 | Galanty | 241/243 X |
| 4,423,844 | 1/1984 | Sorug et al. | 241/285 B X |
| 4,491,278 | 1/1985 | Galanty | 241/243 |
| 4,691,871 | 9/1987 | Mochizuki | 241/285 A X |

FOREIGN PATENT DOCUMENTS 3827592 10/1989 Fed. Rep. of Germany ... 241/285 B

OTHER PUBLICATIONS

Chicago Comminutor Engineering Bulletin ©1940.

*Primary Examiner*—Mark Rosenbaum
*Assistant Examiner*—Frances Chin
*Attorney, Agent, or Firm*—Clay Holland, Jr.

[57] ABSTRACT

An in-line crushing system is provided which is capable of reducing and crushing both wet and dry material pieces passing therethrough to free-flowing sizes, that utilizes an internal stationary cutter array in conjunction with coaxially aligned rotatable drum or shaft for intermeshing shredding action between the stationary cutter array and cutting blades affixed to the drum or shaft. The operative mechanical crushing structural features of the crushing system provides for convenient accessibility and removal of the cutter array and cutting blades from an inner housing space of the system along a path transverse to a material flow path of the system, without disruption of the system's physical in-line arrangement or location owing to the lack of a need to remove the entire in-line crushing system for purposes such as inspection, repair or replacement of the cutter array and cutting blades in combination.

4 Claims, 6 Drawing Sheets

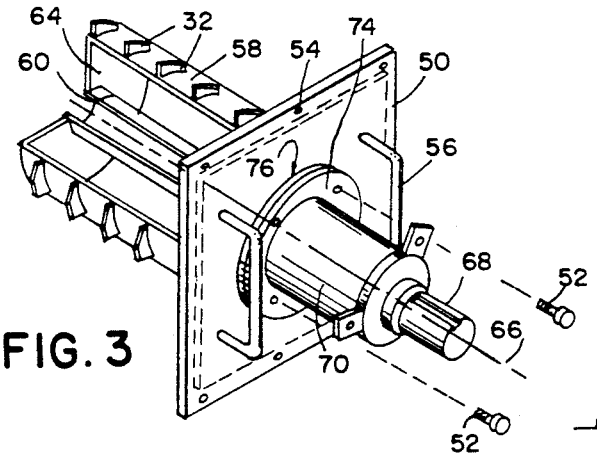
FIG. 3
FIG. 4
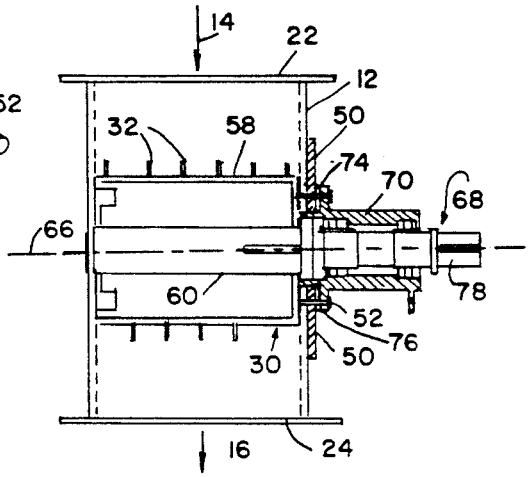
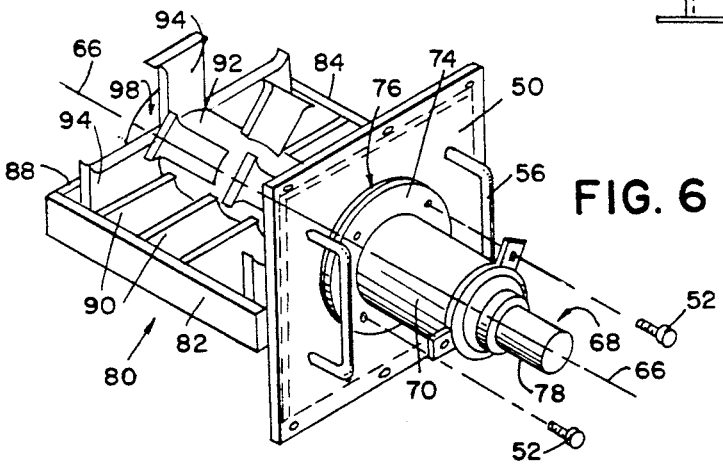
FIG. 6
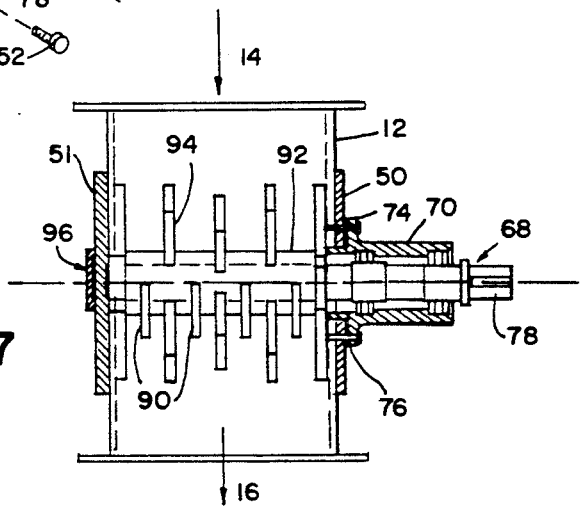
FIG. 7

CRUSHING DEVICE

BACKGROUND OF THE INVENTION

This invention relates to a class of devices which may be generally characterized as crushers, pulverizers, shredders, comminutors, and the like. Such devices may be further characterized as capable of reducing or crushing material pieces passing therethrough which may be dry, wet or in a liquid medium. The reducing or crushing process provided by these devices renders the larger material pieces to smaller free-flowing sizes as a result of a cutter array in intermeshing action with a plurality of rotable cutting or crushing blades or teeth.

The present invention is concerned primarily with operable mechanical crushing features which provides for convenient accessability and removal thereof without disruption of a system's physical in-line arrangement. In the prior art such devices may have had fixed cages or stationary cutting and shredding bars which are in coaxial rotatable intermeshing relationship with cutting blades or teeth for size reduction of materials passing therebetween. In general, however, these prior art devices have not provided the means whereby accessibility to these intermeshing and shredding members are readily and conveniently available for inspection, repair or replacement of members, where desired without material disruption of the system into which they may have been incorporated.

Devices of the type to which the present invention relates are known and described in the prior art, for example, such as U.S. Pat. No. 2,870,969, to W. E. Moore, issued Jan. 27, 1959, entitled "Ice Crusher". This device, includes a housing adapted to receive conventional size ice cubes through a top opening. At the lower end of the housing, two sets of parallel vanes are provided, each set extending a different proportion of the distance from one side of the housing to the center thereof. A crank operated crush assembly is disposed centrally of the crusher and has crusher teeth which are arranged to pass between adjacent vanes of the housing. The foregoing patent discloses the principle of engaging and fracturing conventional ice cubes by means of crushing engagement between the parallel vanes fixedly extending from the housing and the series of intermeshing teeth rotably passing between adjacent vanes by means of a hand crank arrangement. As shown and disclosed the vanes which are affixed to the housing and can not readily and conveniently be repaired or replaced. It should be noted that this device is not adaptable for integration as part of an in-line system.

In U.S. Pat. No. 3,556,421, to Harold E. Galanty, issued Jan. 19, 1971, entitled "Chopping Machine", there is disclosed a chopping machine adapted to be connected to a duct through which solid material is transported by a stream of fluid. The device comprises a grating unit and a cooperating chopping unit having chopper blades. The chopper unit is related so that the blades pass into and out of slots in the grating with a clearance, whereby the smaller size pieces pass through the grating as the larger size pieces are chopped into a size which will freely pass through the grating. This is another example of a device capable of rending larger pieces of material into smaller pieces by means of a plurality of rotating chopping teeth which engage larger size pieces and render them smaller. However, it can be seen that the grating unit has vanes or blades which extend from the housing wall to the center thereof and are an integral part thereof. Consequently, the grating unit can not readily and conveniently be repaired or replaced without disruption or removal of the entire unit to perform repair or replacement work thereon.

U.S. Pat. No. 4,186,888, to William B. Galanty, issued Feb. 5, 1980, entitled "Comminutor for Sewage Flowing in Liquids", discloses a comminutor for channels or in-line conduits which includes a semicylindrical concave cage formed of a plurality of axially spaced apart sections of arcuate rings or bars connected together arcuately and axially. A plurality of comb-like members are mounted at spaced intervals along the inner surface contour of the semi-cylindrical concave cage member with the teeth of its comb-like members in axial alignment with corresponding sections of the rings or bars which form the cage member. A plurality of rotatable cutting and shredding arms are mounted axially along a helical spiral like path in spaced relationship with the cage member with a plurality of comb-like members for interengaging comminuting action with radially extending portions of their respective teeth. The teeth of the cutting and shredding arms may be in engagement with each tooth of the comb-like member and each of the slotted openings of the cage member at least once during each revolution of the cutting and shredding arms. The construction of this device is such that its may not be readily or conveniently inspected or repaired when it is used in an in-line system without disrupting the entire system.

U.S. Pat. No. 4,491,278, issued Jan. 1, 1985, to William B. Galanty, entitled "Comminutor for In-line Flow of Sewage", is considered as an improvement of invention disclosed in U.S. Pat. No. 4,186,888 issued to the same inventor, and discloses an improved comminutor having a one piece stationary hemispherical cage member and a companion one piece spherical-like rotatable cutting and shredding member adapted for use with the hemispherical cage in crushing and shredding action.

Although the inventive device provided an improvement to the prior art, as an in-line component device it does not include the features which would enable it to be inspected, repaired or provided with replacement parts without the physical removal of the entire unit which would be inconvenient, time consuming and costly. Thus, it can readily be appreciated from such prior art devices that there is a need for devices of this and other types which overcome the disadvantages of such prior art devices.

SUMMARY OF THE INVENTION

The present invention is an improved crushing device for in-line systems operation having a housing for containing a removable crushing means therein, the housing having an input opening for receiving material pieces and an outlet opening for discharging smaller size pieces material pieces which have been reduced in size while passing through the crushing means enroute to the outlet opening.

The novelty of the invention resides primarily in the physical attributes of an in-line crushing device wherein accessibility to a removable crushing means, which consists of a cutter array and cutting teeth or blades connected to a drum or shaft, may be readily available for ease of inspection, removal or replacement. Accessibility to the internal mechanism of the device is possible without the need to dismantle or disassemble the entire system simply by removal of at least one cover or end plates which permits the internal components to be inspected and by removal of two end plates to completely remove the entire crushing means. However, the removal of the end plates which may provide for liquid sealing does not require dismantling of the system to make replacement or repairs. In a liquid system, it is only necessary only to close off an upstream shut off valve during a repair or replacement operation. Thus it can be seen that the features of the present invention may appear to be simple and less complex than many of the sophisticated concepts in today's high-tech society, but it is new, useful and unobvious in that it solves a long standing void and problem, arising from the need to facilitate the inspection, repair or replacement within a system in manner that is efficient and cost effective. No known prior art devices of the type disclosed and taught by the present invention offers solutions as provided by the present invention.

BRIEF DESCRIPTION OF THE DRAWINGS

Realization of the above unique features and advantages along with others of the invention will be more apparent from the following description and accompanying drawings in which.

FIG. 3, is a view of an assembled drum, shaft and bearing support arrangement of the device shown in FIGS. 1 and 2;

FIG. 4, is a view of the device shown in FIG. 1 taken along lines 4—4 of FIG. 1;

FIG. 6, is a view of an assembled cutter array, coaxial aligned rotatable cutting members, shaft and bearing support arrangememt of the device shown in FIG. 5;

FIG. 7, is a view of the device shown in FIG. 5 taken along lines 7—7 of FIG. 5;

DESCRIPTION OF REPRESENTATIVE EMBODIMENTS OF THE INVENTION

Figure 1:
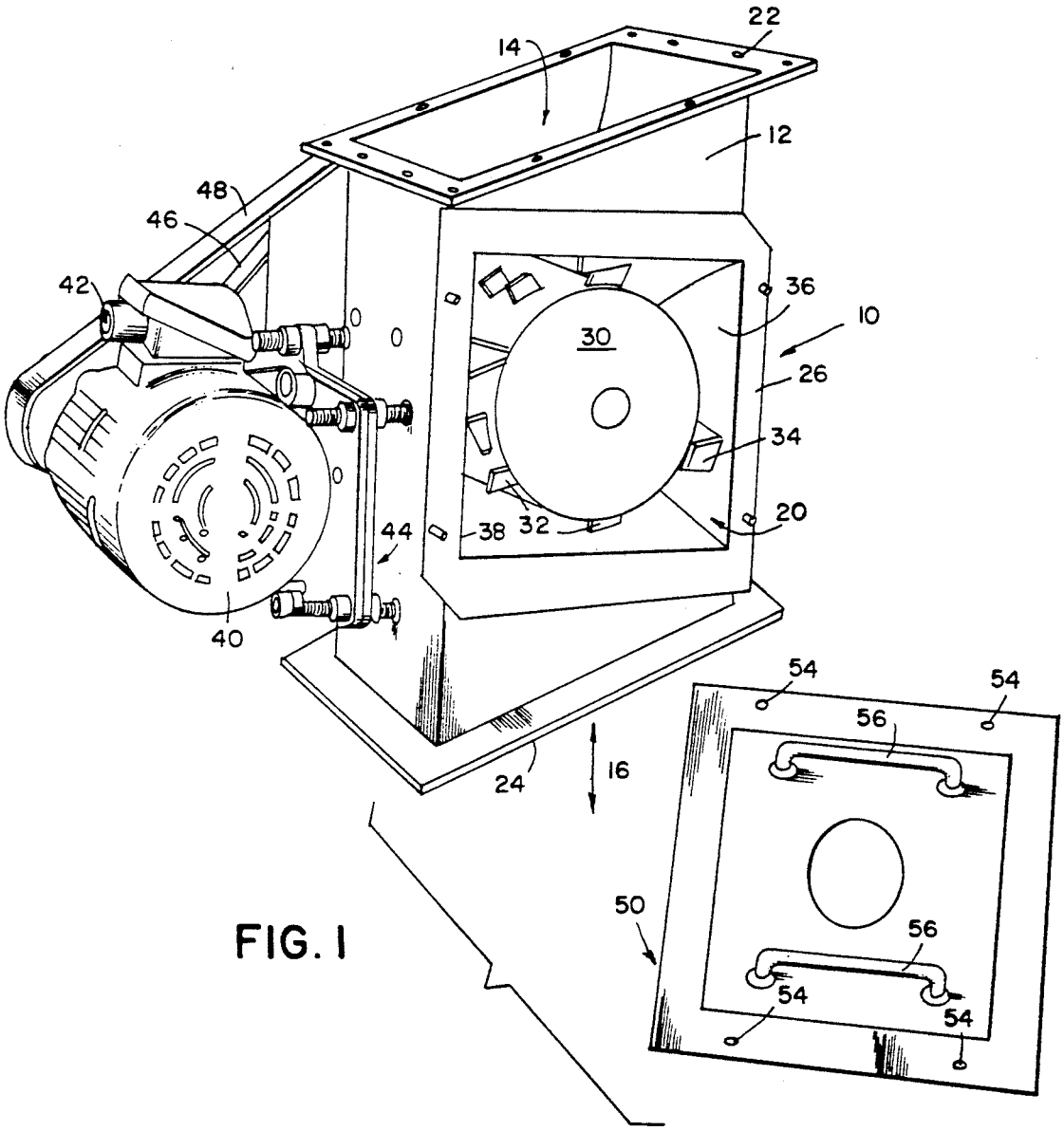
FIG. 1, is a detail perspective view of a crushing device embodying the present invention.

Referring now to the drawings, there is shown in FIG. 1, an embodiment of the improved crushing device 10 which includes a rectangular housing or body 12, having an inlet opening 14 and an outlet opening 16, the distance therebetween being designated a flow-path 18. Perpendicular to flow-path is an opening 20 passing through housing 12. As shown opening 20 is square in its configuration, but may be circular or other configurations. Body 12 has an inlet opening flange 22, an outlet opening flange 24, a first perpendicular opening flange 26 and a second perpendicular opening flange 28, which is not shown in FIG. 1, Continuing with the description of the device in FIG. 1, there is shown a drum 30 having a plurality of teeth 32 connected to outer periphery of drum 30 and extending radially therefrom into opening 20. There are at least two cutter array bars or combs 34 in axial alignment with drum 30 and teeth 32 and each attached in stationary positions on opposite first and second wall surfaces 36 and 38, respectively. As shown in FIG. 1, an electrical motor 40 having an electrical input power connector 42 is mounted to outer body wall surface 38 by means of a motor plates mounting arrangement 44. Also shown in FIG. 1 is a drive belt 46 extending from motor 40 to device 10, which belt is covered over by a pulley and belt cover 48. Finally, there is shown a removable opening cover 50 which may be bolted to body flange 26 by a plurality of appropriate bolts 52 utilizing a plurality of openings 54 in cover 50. A pair of U-shaped handles 56 connected to cover may be used to assist in the removal or attaching cover 50 to the body of the device.

Figure 2:
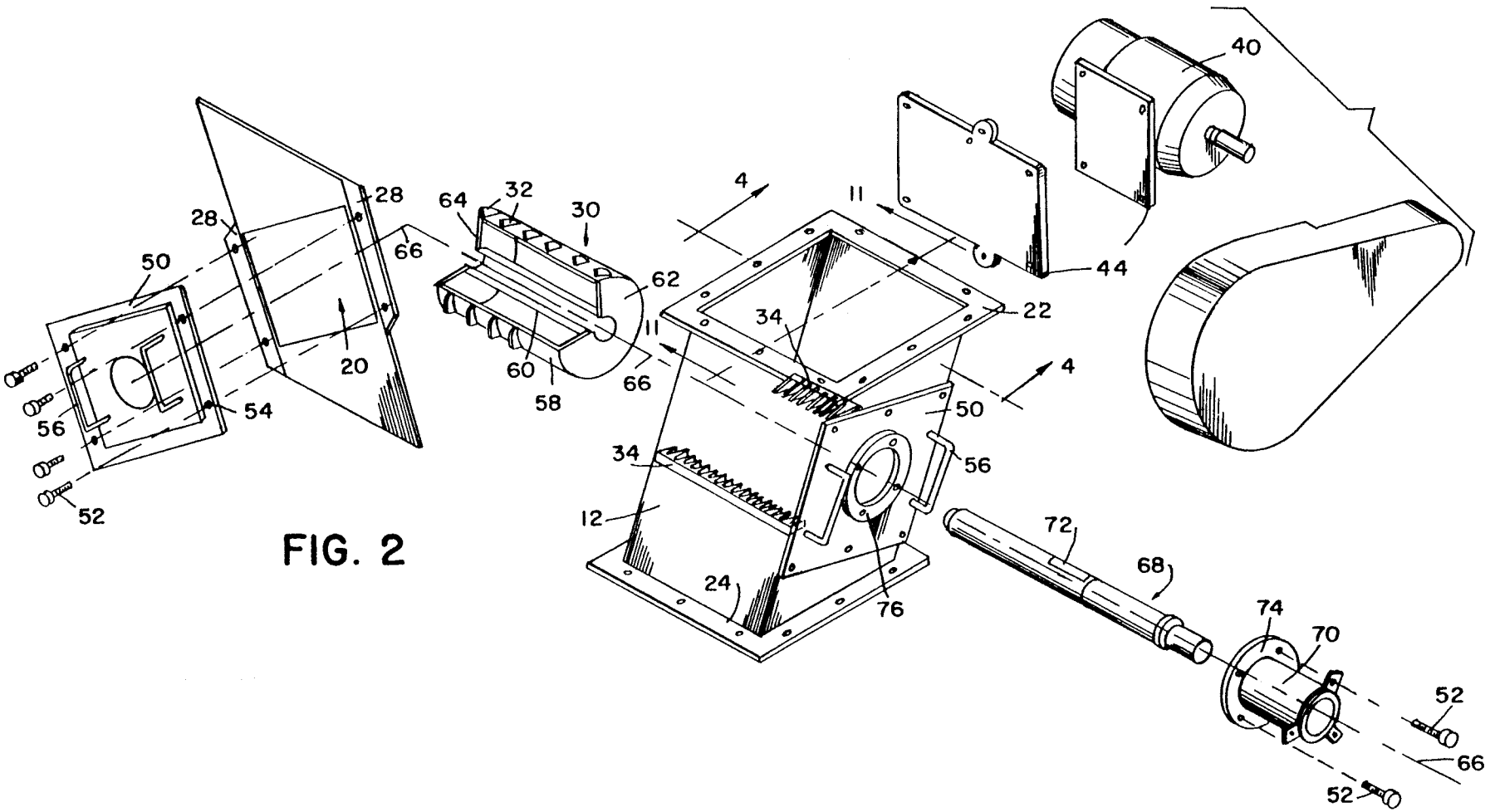
FIG. 2, is a detail disassembly perspective view of the device shown in FIG. 1, illustrating in a projection sequence the various elements thereof.

Now referring to FIG. 2, device is shown disassembled so that the component parts and their relative spaced relationships can be more readily seen and understood. As shown body 12 has cutter array bars or combs 34 connected in stationary positions to opposite first and second inner body wall surfaces 36 and 38, respectively, for coaxial alignment with drum 30. Drum 30 consists of an outer cylindrical body 58 and an inner cylindrical body 60 disposed coaxially therewith. These two cylindrical bodies are each connected at their respective remote ends by first and second end pieces 62 and 64, respectively, to thereby form a rigid drum structure. Connected to the periphery of body 58 is a plurality of cutting or crushing members or teeth 32. As shown drum 30 is disposed along an axis 66 which is the axis for a shaft 68 and a bearing support member 70. Shaft 68 has a keyway 72 which is useful for locking drum 30 along the shaft. Bearing support 70 has a ring-like plate flange 74 which mates with a ring-like plate 76 affixed to one of two covers 50 to provide support for drum 30 and shaft 68 in cantilever arrangement.

Referring to FIG. 3, there is shown an assembly of drum 30, shaft 68 and bearing support device 70 disposed in axial alignment for rotation of drum 30 about axis 66. In FIG. 4, there is shown a view of crushing device 10 taken along lines 4—4 of FIG. 1. As shown the relative spaced apart relationship of the various elements can clearly be seen and understood. A protruding end 78 of shaft 68 is provided to receive a pulley (not shown) which is driven by pulley belt 46, shown in FIG. 1, to produce rotary motion for drum 30 which in turn causes crushing and shredding action between teeth 32 affixed to drum 30 and cutter array bars or combs 34 (not shown) located in spaced apart parallel intermeshing relationship with teeth 32.

Figure 5:
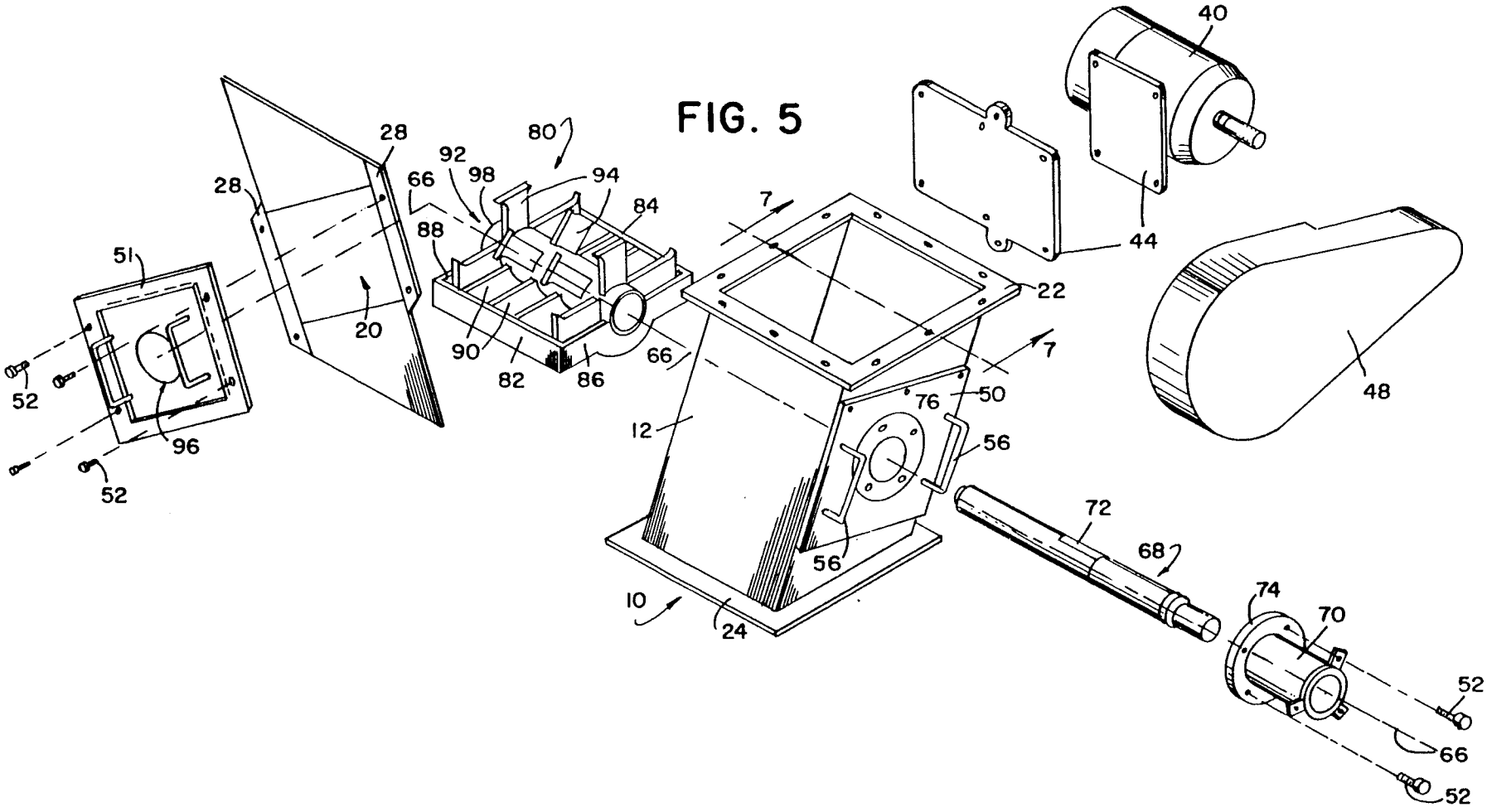
FIG. 5, is a detail disassembly perspective view of another embodiment of a crushing device, illustrating in a projection sequence the various elements thereof.

Referring to FIG. 5, there is shown another embodiment of the invention, wherein the primary difference between the devices of FIGS. 2 and 5, resides in the cutter array and the cutting teeth arrangements. In FIG. 5, a cutter array 80 consists of a rectangular frame of first and second parallel members 82 and 84, respectively, and a pair of third and fourth parallel frame members 86 and 88, one of each being fixedly connected to opposite ends of frame members 82 and 84 to form a rigid frame configuration. A plurality of cutter members 90 project, respectively from members 82 and 84 towards axis 66 and are fixedly connected to such frame members. A tubular sleeve member 92 is disposed axially along the length of array 80 parallel to frame members 82 and 84. A plurality of cutting teeth 94 extend radially from sleeve 92 and are fixedly connected thereto forming an intermeshing relationship with array cutter members 90 for crushing and shredding pieces of material encountering the crushing arrangement.

As shown in FIG. 5, a cover 51 that is similar to cover 50 is adapted by a mechanical means 96 for receiving a remote end 98 of sleeve member 92 along axis 66 that may be used to provide additional support to sleeve 92 and teeth 94.

Referring now to FIG. 6, there is shown an assembly of cutter array 80, shaft 68 and bearing support device 70, disposed in axial alignment for rotation of sleeve 92 and teeth 94 for intermeshing material crushing relationship with cutter members 90. In FIG. 7, there is shown a view of crushing device 10, taken along lines 7—7 of FIG. 5. As shown the relative spaced apart relationship of the various elements are depicted for clarity and better understanding of the construction and operation of the device in this second embodiment of the invention. It should be noted that frame members 82 and 84, in operation of the device are fixedly connected to opposite inner side walls of housing 12 by appropriate means, such as bolts for example, to thereby maintain cutter array 80 stationary during the process of crushing materials which flow therethrough. As noted above shaft end 78 is driven in rotary motion by an attached pulley (not shown) pulley belt 46 and drive motor 40 arrangement to provide the rotary crushing motion and action between teeth 94 and cutter bars or members 90.

Figure 8:
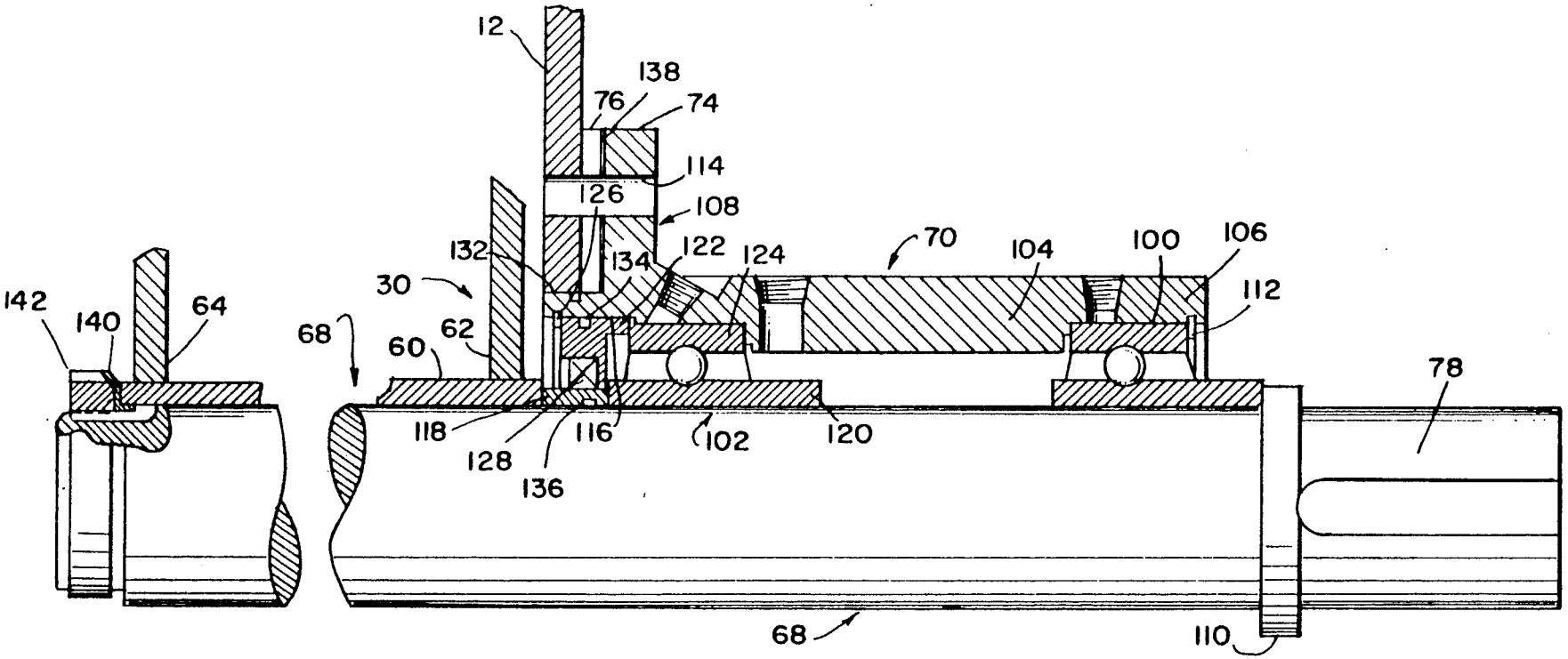
FIG. 8, is a partial cross-section view of a shaft, drum and bearing support arrangement of the device shown in FIGS. 1 and 2.

Continuing with the description, FIG. 8 is a partial cross-sectional view of shaft 68, bearing support 70 and drum 30 of the embodiment shown in FIGS. 1 and 2. It should be noted that the bearing support arrangement shown illustrates an arrangement that may be utilized both for non-liquid and liquid systems. Shaft 78 has a first race and bearing device 100 and a second race and bearing device 102 that are disposed coaxially therealong, which supports a bearing housing 104, along its axial length. Race 100 supports a remote end 106 of bearing housing, while race 102 supports a flange end 108 of bearing housing 104 near flange 74. Race 100 abuts a shaft retainer ring 110 and a snap-in retainer ring 112. Retainer rings 110 and 112 help to lock bearing housing 104 in place along with a plurality of bolts (not shown) through bolt opening 114 in flange 74, firmly securing bearing housing 104 to housing body 12. The flange end of support bearing housing 104 has an inner annular bore 116 adjacent race 102. A thrust wear sleeve 118 is fitted onto shaft 68 at an exposed end of race 102 and is in snug fitting contact with a lower race member 120. A seal gland member 122 fits snugly against inner annular bore 116 and an upper race member 124 and is held in position by a seal gland retainer ring 126. An annular oil packing seal gland member 122, to thereby assist in providing liquid sealing capabilities along shaft 68 and support member 70. In addition to a seal member 128, there are three o-rings for liquid sealing purposes, a first o-ring 130 set in a slot in an outer cylindrical section 132 of bearing support 70 and body 12 adjacent flange 74 plate 76; a second o-ring 134 disposed between inner bore 116 and the outer annular surface of seal gland 122 and is set in a slot therein; and a third o-ring 136 is disposed between shaft 68 and thrust wear sleeve 118 set in a slot in the inner bore of sleeve 118. These four sealing members along with a disc-like gasket seal member 138 disposed between flange 74 and member 76, used when required with a liquid-flow system, to provide liquid sealing between body 12 and support member 70.

To continue, drum 30 is disposed axially along shaft 68 is held firmly in place thereon by means of keyway 72 (not shown in FIG. 8) shown in FIG. 2, and a lock washer 140 and nut 142 along with keyway 72 secures drum 30 to shaft 68 along inner drum tube 60 so that the drum rotates as shaft 68 rotates. In doing so, teeth 32 intermesh with bars 34 to provide the crushing or shredding action for device 10. Bearing support device 70 is adaptable for use with each embodiment of the invention disclosed and claimed herein.

Figures 9, 10:
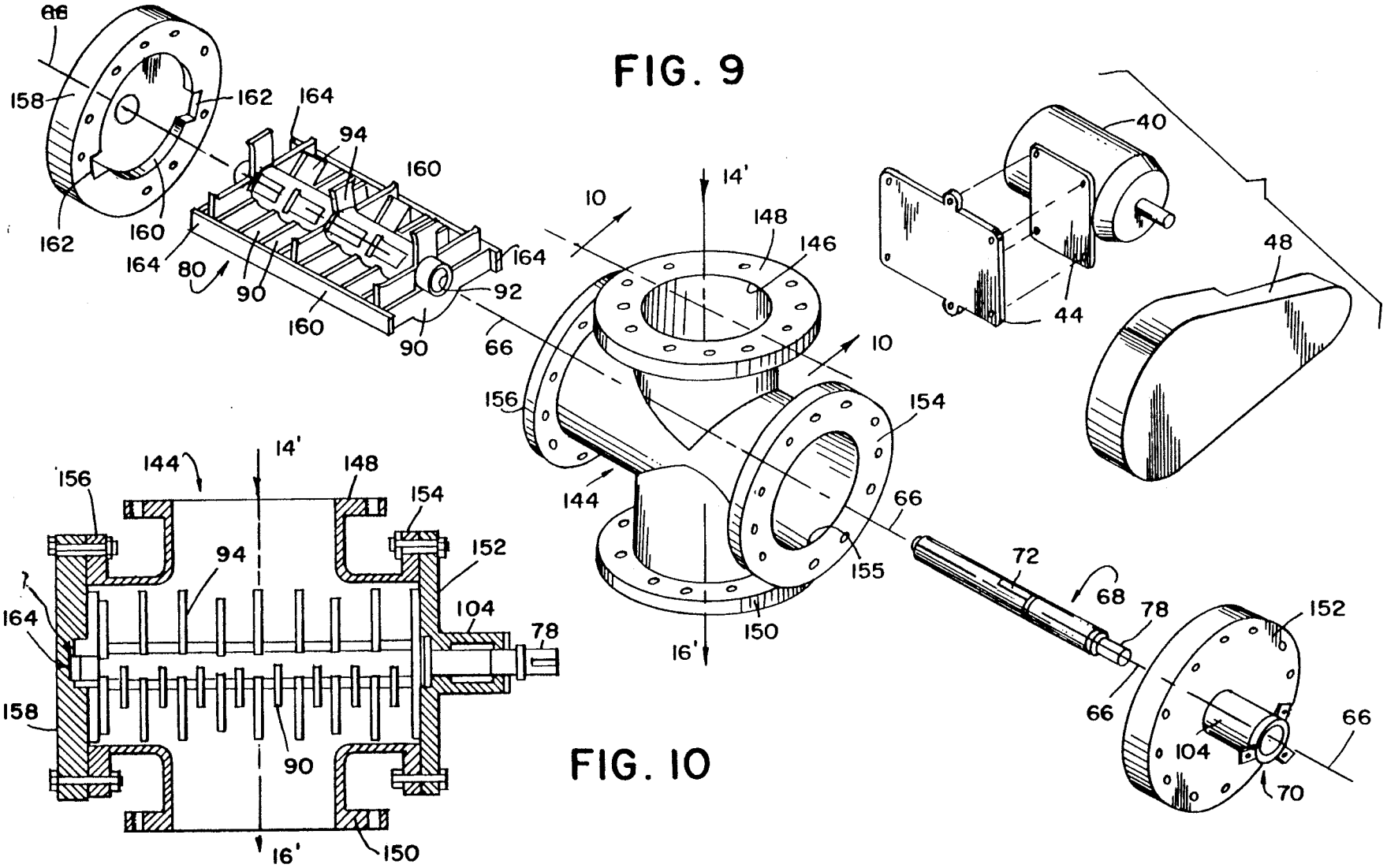
FIG. 9, is a detail disassembled perspective view of another embodiment of a crushing device, illustrating in a projection sequence the various elements thereof.
FIG. 10, is a view of the device shown in FIG. 9 taken along lines 10—10 of FIG. 9.

Referring now to FIG. 9, thereis shown another embodiment of the invention which is useful for conventional liquid-flow systems which may traditionally utilize a t-shaped body or housing 144 having an input opening 146 passing along a vertical axis designated by arrows references 14' and 16' from an input end 14' to an output end 16'. At the input end there is a circular flange 148, used to connect device 144 to a liquid-flow system, for example, and at an outlet end there is a second circular flange 150, used to connect and incorporate device 144 to a liquid-flow system. Once devices 10 or 144 are connected to a system, whether a dry or wet system, they are characterized as locked in place to become an integral part thereof.

As shown in FIG. 9, there is a bearing support device 70 which is similar in construction and operation as that shown in FIGS. 1 and 2, except that the member in FIG. 9 has a larger end plate member 152 connected to its support body member 104. End plate member 152 is designed to mate with a first circular flange member 154 which is part of T-shaped housing 144 and is disposed axially along axis 66. Flange 154 has a circular opening 155 therein which continues through housing 144 and exits on the opposite side of housing 144 along axis 66. A second circular flange member 156 is axially disposed along axis 66 connected to housing 144 opposite flange 154 in alignment with opening 155. A second circular end member 158 is shown which mates with flange 156 of housing 144 to thereby seal the housing in cooperation with support 70. As shown end member 158 has a circular opening 160 formed therein with a pair of diametrically disposed opposing slots 162 formed therein. Slots 162 are provided to receive the extended ends of cutter array 80, where parallel frame members 160 extend axially beyond frame members 90. A pair of extended ends 164 of frame members 160 will fit securely into slots 162 when the device is assembled in operation. Similar slots 162 (not shown in FIG. 9) are also formed in end member 152 in axial alignment therewith, so as to provide means for firmly fixing and positioning cutter array 80 within housing 144 perpendicular to the system material flow-path for crushing or sizing such materials. The foregoing slotted construction features for firmly and stationary positioning cutter array 80 within housing is a simple but adequate means to provide the crushing or sizing capabilities of the device in accordance with the teachings of the present invention, while providing the unique advantage thereof for ease of disassembly for inspection, repair or replacement of components of the device without disrupting the integrity of the system into which a device has been incorporated.

Referring to FIG. 10, there is shown an assembled device of FIG. 9 taken along lines 10—10 thereof, depicting the spaced apart relationship of the various principle component elements thereof.

Operation of the various embodiments of the present invention are similar or equivalent, i.e. that of axially aligned stationary cutter array intermeshing with axially aligned rotatable cutting teeth disposed and fixedly connected to a rotatable shaft by means of a drum, shaft sleeve or directly to the shaft member. The advantages observed in view of the teachings disclosed herein with reference to various drawings clearly demonstrate the ease and efficiency with which the crushing device may be inspected, repair etc. without the need to disrupt the system incorporating the device as is required with known prior art devices.

In closing, it is understood that the above described embodiments are only illustrative of the principals to the present invention. Various modifications and adaptations may be envisioned by those skilled in the art when exposed to the teachings herein, without departing from the spirit and scope of the invention and the claims appended hereto. For example, the cutter array and cutting teeth arrangement may be envisioned as constructed a unitary structure to thereby avoid the need to support the cutter array by attaching it to the inner housing walls or to both of the end members of the device, but may be connected to only one end member which may be part of the cantilevered support structure disclosed. Such modification or adaptation would have the advantage of permitting inspection of the internal parts of the device by removal of only one end member and the require the removal of both end members when it is necessary to remove the entire cutter array and cutting teeth.

What is claimed as new is:

1. In an improved shredding device used in an in-line system having an internal structural arrangement of elements therein adapted for ease of removal and disassembly without disruption of the physical structural arrangement of said in-line system into which said device may be incorporated, the improvement comprising:

a. a housing connected to said in-line system as an integral part thereof for receiving at an input opening the flow of material pieces passing through said in-line system and an inner housing space defining opposing inner walls thereof along a material flow path and for discharging said material through a discharge opening for sized material pieces passing therethrough along said material flow-path, said housing having opposing openings defining a path or axis transverse to said material flow-path to provide ready access to said inner housing space and removal of said internal structural arrangement of elements therefrom;

b. a shredding assembly of said internal structural arrangement consisting of a shaft, a drum coaxially engaging said shaft and having an array of fixed spaced apart shredding teeth extending therefrom transverse to said material flowpath, and a pair of spaced apart parallel shredding bars each fixedly connected to said opposing inner walls of said housing, said bars having an array of fixed spaced apart parallel shredding blades extending outwardly from said inner walls transverse to said material flow-path in intermeshing shredding relationship with said teeth for shredding and sizing material along said material flow-path;

c. first and second end members sealed and mating with said opposing opening to thereby enclose said inner housing space for containing said shredding assembly in a fixed space position within said housing, and to support said shaft at one end by a cantilever bearing support which is an integral part of one of said end members and at the other end by said other end member; and d. a motor coupled to said shredding assembly through said cantilever bearing support, whereby rotational drive motion is applied to said support for sizing larger pieces into smaller pieces as said material pieces pass through said shredding device.

2. In an improved shredding device used in an in-line system having an internal structural arrangement of elements therein adapted for ease of removal and disassembly without disruption of the physical structural arrangement of said in-line system into which said device may be incorporated, the improvement comprising:

a. a housing connected to said in-line system and an integral part thereof for receiving at an input opening the flow of material pieces passing through said in-line system and an inner housing space along a material flow-path for discharging said material through a discharge opening for sized material pieces passing therethrough along said material flow-path, said housing having opposing openings defining a path or axis transverse to said material flow-path to provide ready access to said inner housing space and removal of said internal structural arrangement of elements therefrom;

b. a shredding assembly of a unitary removal structure consisting of a shaft, a sleeve coaxially engaging said shaft having an array of fixed spaced apart shredding teeth extending outwardly therefrom transverse to said material flow-path, and a rectangular frame member having opposing frame members in coaxial alignment with said shaft and sleeve, having an array of fixed spaced apart parallel shredding blades extending outwardly therefrom between said opposing frame members transverse to said material flow-path and in intermeshing shredding relationship with said teeth for shredding and sizing material along said material flow-path;

c. first and second end members sealed and mating with said opposing openings to thereby enclose said inner housing space for containing said shredding assembly in a fixed spaced position within said housing, and to support said shaft at one end by a cantilever bearing support which is an integral part of one of said end members and at the other end by said other end member; and d. a motor coupled to said shredding assembly through said cantilever bearing support, whereby rotational drive motion is applied to said support for sizing larger pieces into smaller pieces as said material pieces pass through said shredding device.

3. In an improved shredding device used in an in-line system having an internal structural arrangement of elements therein adapted for ease of removal and disassembly without disruption of the physical structural arrangement of said in-line system into which said device may be incorporated, the improvement comprising;

a. a housing structure having a t-shaped configuration with first opposing opening connected to said in-line system for receiving incoming material pieces therefrom for sizing and a remote down stream outlet opening disposed along a material flow-path for discharge of said sized material pieces therefrom;

b. said housing having second opposing openings each with outer end flanges defining a path or axis transverse to said material flow-path to provide ready access to an inner housing space and removal of said internal structural arrangement of elements therefrom;

c. a shredding assembly of said internal structural arrangement consisting of a shaft, a sleeve coaxially engaging said shaft and having an array of fixed spaced apart shredding teeth extending therefrom transverse to said material flow-path and a rectangular frame member having opposing members in coaxial alignment with said shaft and sleeve, having an array of fixed spaced apart parallel shredding blades extending between said opposing frame members transverse to said material flow-path and in intermeshing relationship with said teeth for shredding and sizing material along said material flow-path;

d. first and second end plate members sealed and mated respectively with said second end opposing flanges to thereby enclose said inner housing space for containing said shredding assembly and for supporting and retaining said shredding assembly in a fixed position within said housing supported at one end by a cantilever bearing support which is an integral part of one of said end plates and at the other end by said other end plate; and e. a rotational drive motor coupled to said shaft to thereby provide rotational motion to said shaft for sizing material pieces along said material flow-path as said material pieces are shredded between said shredding teeth and blades.

4. In an improved shredding device of claim 3, wherein said shaft is rotatably connected to an supported by a non-rectangular frame at one end, said non-rectangular frame having opposing side members in axial alignment along said shaft, having an array of fixed spaced apart parallel shredding blades extending between said opposing side members of said non-rectangular frame transverse to said material flow-path, and at the other end by said non-rectangular frame and end plate having a cantilever bearing support, said shaft having an array of fixed spaced apart parallel shredding teeth extending outwardly therefrom transverse to said material flowpath and in intermeshing shredding relationship with said shredding blades of said non-rectangular frame.

* * * * *